US008630431B2

(12) United States Patent
Gran

(10) Patent No.: US 8,630,431 B2
(45) Date of Patent: Jan. 14, 2014

(54) BEAMFORMING IN HEARING AIDS

(75) Inventor: Karl-Fredrik Johan Gran, Malmö (SE)

(73) Assignee: GN Resound A/S, Ballerup (DK)

( * ) Notice: Subject to any disclaimer, the term of this patent is extended or adjusted under 35 U.S.C. 154(b) by 233 days.

(21) Appl. No.: 12/976,985

(22) Filed: Dec. 22, 2010

(65) Prior Publication Data

US 2012/0008807 A1 Jan. 12, 2012

(30) Foreign Application Priority Data

Dec. 29, 2009 (EP) ..... 09180883

(51) Int. Cl.
*H04R 25/00* (2006.01)

(52) U.S. Cl.
USPC ..... 381/313; 381/23.1; 381/315

(58) Field of Classification Search
USPC ..... 381/313, 315, 23.1
See application file for complete search history.

(56) References Cited

U.S. PATENT DOCUMENTS

| | | | | |
|---|---|---|---|---|
| 6,751,325 | B1 * | 6/2004 | Fischer | 381/313 |
| 7,206,421 | B1 * | 4/2007 | Taenzer | 381/119 |
| 7,340,073 | B2 * | 3/2008 | Fischer | 381/313 |
| 8,194,881 | B2 * | 6/2012 | Haulick et al. | 381/94.1 |
| 8,194,900 | B2 * | 6/2012 | Fischer et al. | 381/313 |
| 8,199,833 | B2 * | 6/2012 | Bennett | 375/240.28 |
| 8,249,284 | B2 * | 8/2012 | Allegro-Baumann et al. | 381/309 |
| 2004/0252852 | A1 | 12/2004 | Taenzer | |
| 2005/0244018 | A1 | 11/2005 | Fischer et al. | |
| 2008/0107297 | A1 | 5/2008 | Fischer et al. | |
| 2008/0253596 | A1 | 10/2008 | Klinkby et al. | |
| 2010/0027820 | A1 | 2/2010 | Kates | |

FOREIGN PATENT DOCUMENTS

| | | | |
|---|---|---|---|
| CN | 101356854 | A | 1/2009 |
| CN | 101529929 | A | 9/2009 |
| JP | 2000-253498 | A | 9/2000 |
| WO | 99/09786 | A1 | 2/1999 |
| WO | 00/47015 | A1 | 8/2000 |
| WO | 01/10169 | A1 | 2/2001 |
| WO | 2007098768 | | 9/2007 |
| WO | 2007128825 | | 11/2007 |
| WO | 2009144332 | | 12/2009 |

OTHER PUBLICATIONS

European Search Report dated Jun. 4, 2010 for EP App No. 09180883.2.

(Continued)

*Primary Examiner* — Curtis Kuntz
*Assistant Examiner* — Ryan Robinson
(74) *Attorney, Agent, or Firm* — Vista IP Law Group, LLP

(57) ABSTRACT

A hearing aid system includes a first microphone and a second microphone for provision of electrical input signals, a beamformer for provision of a first audio signal based at least in part on the electrical input signals, the first audio signal having a directional spatial characteristic, wherein the beamformer is configured to provide a second audio signal based at least in part on the electrical input signals, the second audio signal having a spatial characteristic that is different from the directional spatial characteristic of the first audio signal, and a mixer configured for mixing the first audio signal and the second audio signal in order to provide an output signal to be heard by a user.

12 Claims, 11 Drawing Sheets

(56) References Cited

OTHER PUBLICATIONS

Japanese Notice of Reasons for Rejection dated Nov. 20, 2012, for JP Patent Application No. 2010-288110.
First Office Action dated Feb. 5, 2013 for Chinese Patent Application No. 201010621662.2.
English Translation of First Office Action dated Feb. 5, 2013 for Chinese Patent Application No. 201010621662.2.
Extended European Search Report dated Jul. 19, 2013 for EP Patent Application No. 13163707.6.
Japanese Decision on Rejection dated Aug. 27, 2013, for related Japanese Patent Application No. 2010-288110, 5 pages.

* cited by examiner

BEAMFORMING IN HEARING AIDS

PRIORITY DATA

This application claims priority to, and the benefit of, European patent application No. 09180883.2 filed on Dec. 29, 2009.

FIELD

The present application pertains to a hearing aid system with the capability of beamforming in general and to adaptive binaural beamforming in particular.

BACKGROUND

One of the most important tasks for modern hearing aids is to provide improvement in speech intelligibility in the presence of noise. For this purpose, beamforming, especially adaptive beamforming, has been widely used in order to suppress interfering noise. Traditionally, the user of a hearing aid is given the possibility of changing between a directional and a omni-directional mode in the hearing aid (e.g. the user simply changes processing modes by flipping a toggle switch or pushing a button on the hearing aid to put the device in the preferred mode according to the listening conditions encountered in a specific environment). Recently, even automatic switching procedures for switching between directional and omni-directional modes have been employed in hearing aids.

Both omni-directional and directional processing offer benefits relative the other mode, depending upon the specific listening situation. For relatively quiet listening situations, omni-directional processing is typically preferred over the directional mode. This is due to the fact that in situations, where any background noise present is fairly low in amplitude, the omni-directional mode should provide a greater access to the full range of sounds in the surrounding environment, which may provide a greater feeling of "connectedness" to the environment, i.e. being connected to the outside world. The general preference for omni-directional processing when the signal source is to the side or behind the listener is predictable. By providing greater access to sound sources that the listener is not currently facing, omni-directional processing will improve recognition for speech signals arriving from these locations (e.g., in a restaurant where the server speaks from behind or from the side of the listener). This benefit of omni-directional processing for target signals arriving from locations other than in front of the listener will be present in both quiet and noisy listening situations. For noisy listening conditions where the listener is facing the signal source (e.g., the talker of interest), the increased SNR provided by directional processing for signals coming from the front is likely to make directional processing preferred. Each of the listening conditions just mentioned (in quiet, in noise with the hearing aid user facing or not facing the talker) occur frequently in the everyday experience of hearing-impaired listeners. Thus, hearing aid users regularly encounter listening situations where directional processing will be preferable to the omnidirectional mode, and vice versa.

A problem with the approach of manual switching between omni-directional and directional modes of the hearing aid is that listeners may not be aware that a change in mode could be beneficial in a given listening situation if they do not actively switch modes. In addition, the most appropriate processing mode can change fairly frequently in some listening environments and the listener may be unable to conveniently switch modes manually to handle such dynamic listening conditions.

Finally, many listeners may find manual switching and active comparison of the two modes burdensome and inconvenient. As a result, they may leave their devices in a default omni-directional mode permanently.

However, whether directional microphones are chosen manually by the listener or automatically by the hearing instrument, directional processing is performed by a lossy coding of the sound. Basically directional processing consists of spatial filtering where one sound source is enhanced (usually from 0 degrees) and all other sound sources are attenuated. Consequently, the spatial cues are destroyed. Once this information is removed, it is no longer available or retrievable by the hearing aid or the listener. Thus, one of the major problems with such methods of manual or automatic switching between directional and omni-directional modes is the elimination of information, which occurs when the hearing instrument is switched to a directional mode, which may be important to the listener.

Though the purpose of a directional mode is to provide a better signal-to-noise ratio for the signal of interest, the decision of what is the signal of interest is ultimately the listeners choice and cannot be decided upon by the hearing instrument. As the signal of interest is assumed to occur in the look direction of the listener any signal that occurs outside the look direction of the listener can and will be eliminated by the directional processing. This is in compliance with clinical experience, which suggests that automatic switching algorithms currently being marketed are not achieving wide acceptance. Patients generally prefer to switch modes manually rather than rely of the decisions of these algorithms.

SUMMARY

It is thus an object to provide a hearing aid system by which it is possible to give the user the benefits of both directional and omni-directional modes simultaneously.

According to some embodiments, the above-mentioned and other objects are fulfilled by a a hearing aid system comprising: a first and a second microphone for the provision of electrical input signals, a beamformer for the provision of a first audio signal having a directional spatial characteristic (a beam), based at least in part on the electrical input signals, wherein the beamformer is further being configured to provide a second audio signal, based at least in part on the electrical input signals, the second audio signal having another spatial characteristic than the first audio signal, and wherein the hearing aid system further comprises a mixer being configured for mixing the first and second audio signals in order to provide an output signal to be heard by a user.

By mixing the directional audio signal with an audio signal having another spatial characteristic in order to provide a mixed output signal to be heard by a user, the user achieves the benefit of directional processing (e.g. a better intelligibility of the signal of interest), while at the same time being able to hear sound from other direction(s). Depending of the mixing ratio, i.e. how much of the second audio signal is mixed with the first one, and depending on the spatial characteristic of the second audio signal, the user will be provided with an output signal that has the benefit of directional processing and at the same time feel more connected with the ambient sound environment.

The hearing aid system may according to a preferred embodiment further comprise a processor that is being configured to process the mixed signal according to a hearing impairment correction algorithm. Hereby it is ensured that the mixed signal has a level and frequency characteristic that would be heard by the user. Preferably an output transducer such as a speaker (also called a receiver) is used in the hearing aid system in order to transduce the mixed audio signal into a sound signal.

The hearing aid system according to some embodiments may, alternatively, further comprise a processor that is being configured to process the first audio signal according to a hearing impairment correction algorithm prior to mixing the first and second audio signals. Since, it usually is the first audio signal having the directional characteristic that of primary interest to the user, it is achieved by this alternative embodiment that at least the audio signal, which has the greatest interest to the user, is processed according to the hearing impairment of said user.

According to some embodiments, the beamformer may have one preferred direction. For example defined by the "front look" direction of the user of the hearing aid system, i.e. according to some embodiments, the directional characteristic of the first audio signal may have a direction that is predefined to be in the "front look" direction. Thus, defining a beam in the "front look" direction. While keeping the beam direction fixed the "width" of the beam or shape of the spatial directional characteristic of the first audio signal may according to an alternative embodiment be adaptable or at least adjustable.

The beamformer may preferably be adaptive, i.e. the beamformer optimizes the signal to noise ratio in dependence of the specific situation.

By using an adaptable beamformer is achieved a very flexible solution, wherein it is possible to focus on a moving sound source or to focus on a non-moving sound source, while the user is moving of the hearing aid system is moving. Furthermore, it is possible to better handle changes in the ambient noise conditions (e.g. appearance of a new sound source, disappearance of a noise source or movement of the noise sources relative to the user of the hearing aid system).

In a further preferred embodiment, the hearing aid system may comprise a user operated interface that is operatively connected to the mixer for controlling the mixing of the first and second audio signals. Hereby is achieved the great advantage that the user can decide how much of the ambient sound field he/she may want to hear, and hence turn up and down for how "connected" to the surroundings he/she may want to feel. For example if the user of the inventive hearing aid system is situated at a dinner party, wherein he/she is having a conversation with a person sitting opposite to him/her, while a number of the other participants are talking to each other, then the user will be situated in a sound environment, which often is referred to as multi talker babble noise or just babble noise. In such a situation the user of the inventive hearing aid system will have the clear benefit of directional processing, but may feel left out of the rest of the group of persons at the dinner party, but by using the interface to mix in some of the second audio signal it will enable the user to hear as much of the other conversations that is going on as he/she may chose, while at the same time having the benefit of directional processing with respect to the person with whom the user is presently having a conversation with.

Alternatively or in addition to being user controlled, the mixing of the first and second audio signals may be performed in dependence of a classification of the ambient sound environment. This has the advantage that the audio signal processing in the hearing aid system may be optimized to handle a certain sound or noise environments.

Preferably, the user operated interface may be placed in a separate remote control device, for example similar to a remote control device for controlling a TV, that is operatively connected to the mixer via a wireless link.

Alternatively, the user operated interface may comprise a manually operable switch that may be placed in or on a housing structure of the hearing aid system. The switch may be a toggle switch or a switch that resembles a volume wheel of a hearing aid known in the art. Alternatively, the switch may be embodied as a proximity sensor that is able to register hand or finger movements in the proximity of said sensor. Such a proximity sensor may for example be embodied as a capacitive sensor. In yet an alternative embodiment the switch may be a magnetic switch, such as a reed switch, magneto-resistive, giant magneto-resistive, anisotropic magneto-resistive or anisotropic giant magneto-resistive switch.

While many hearing impaired persons are suffering from a hearing loss in both ears and thus actually use two hearing aids, most of the binaural hearing aid systems process data independently in each hearing aid without exchanging information. However, in recent years, wireless communication has been introduced between the hearing aids so that data can be transmitted from one hearing aid to the other. Thus, according to some embodiments, the hearing aid system may be a binaural hearing aid system comprising a first and a second hearing aid that are interconnected to each other via a communication link, and wherein the first microphone is located in the first hearing aid and the second microphone is located in the second hearing aid. Hereby is achieved a hearing aid system facilitating binaural beamforming. This has among other things the advantage of increased spatial resolution of the beamformer, because the distance between the ears of an average grown up person wearing the first and second hearing aids in or at the ears, is roughly on the order of the wavelength of sound in the audible range. This will thus make it possible to distinguish between spatially closely located sound sources. However, apart from these advantages one concern with binaural beamforming is that the beamformer only generates one signal, effectively destroying all binaural cues like the Interaural Time Difference (ITD), and Interaural Level Difference (ILD) for the noise. These binaural cues are essential for enabling a person to localize sound sources and/or distinguish between sound sources. However by mixing the first and second audio signals the binaural cues may be preserved, while at the same time providing the benefits of directional processing for the user. Simulations have shown that these binaural cues are to a large extent preserved in a hearing aid system according to some embodiments (see for example the section on simulation results). The binaural hearing aid system or the user can determine the level of mixing or mixing ratio that would be desirable for the given situation.

According to a preferred embodiment of the binaural hearing aid system, each of the first and second hearing aids comprises an additional microphone that is connected to the beamformer. Hereby is achieved a binaural hearing aid system that will be able to handle several noise sources at one time, and consequently achieve better noise suppression.

According to a preferred embodiment of the binaural hearing aid, there is provided a manually operable switch for controlling the mixing of the first and second audio signals, which may be placed in the first and/or second hearing aid, for example in a housing structure of the first and/or second hearing aid.

According to yet another preferred embodiment the hearing aid system, according to the description of the present patent specification, may be a single hearing aid forming part of a binaural hearing aid system.

According to a preferred embodiment, the spatial characteristic of the first and second audio signals, which are generated by the beamformer, may be substantially complementary. However, while being substantially complementary they may also be overlapping to a certain extent. A great advantage of this embodiment is that when mixing an increasing part of the second audio signal with the first audio signal, the mixed signal will go from being a substantially directional audio signal to a substantially omni-directional audio signal. Thus, in dependence of the mixing ratio, the system or user may perform a transition (e.g. a soft switching) between substantially directional and substantially omni-directional processing, and thus depending of what may be desirable in any given situation have the benefit of both.

Alternatively, the spatial characteristics of the second audio signal may be substantially omni-directional. Hereby is achieved a system that is computationally simple to implement, because the beamformer only needs to provide one audio signal having a directional spatial characteristic.

According to an alternative preferred embodiment, the spatial characteristics of the first and second audio signals are generated (by the beamformer) in such a way that the resulting spatial characteristic of the mixed audio signal is substantially omni-directional, preferably when a suitably chosen mixing ratio is being used, for example a mixing ratio of $\beta=1$ (to be explained later under the detailed description of the drawings), i.e. when the first and second audio signals are mixed with equal weight.

The mixing itself may be performed in dependence of a hearing loss of a first and/or a second ear of a user, or in dependence of a classification of the ambient sound environment.

According to some embodiments, the above-mentioned and other objects are fulfilled by a a hearing aid comprising: microphones for the provision of a directional audio signal and a omni-directional audio signal, a processor operatively connected to the microphones, and being configured for providing a hearing impairment corrected output signal to be heard by a user, wherein the hearing aid further comprises a mixer for mixing the directional audio signal and the omni-directional audio signal, thereby providing a mixed audio signal.

Some of the embodiments further relate to a hearing aid comprising a user operated interface operatively connected to the mixer, whereby the mixing may be user controlled.

The hearing impairment corrected output signal may, according to some embodiments, be based on the mixed audio signal or the directional audio signal or the omni-directional audio signal.

A hearing aid, according to some embodiments, may be configured for forming part of a binaural hearing aid system.

According to some embodiments, the above-mentioned and other objects are fulfilled by a binaural hearing aid system comprising: a first hearing aid having a directional microphone system for the provision of a directional audio signal and a processor for the provision of a first hearing impairment corrected output signal, a second hearing aid having an omni-directional microphone system for the provision of a omni-directional audio signal and a receiver for the provision of a second hearing impairment corrected output signal, wherein the first hearing aid is adapted to receive an audio signal based on the omni-directional audio signal and the second hearing aid is adapted to receive an audio signal based on the directional audio signal via a bi-directional communication link between the first and second hearing aids, wherein the first hearing aid further comprises a first mixer for mixing signals based on the omni-directional and the directional audio signals in order to provide a first mixed signal, and wherein the second hearing aid further comprises a second mixer for mixing signals based on the omni-directional and the directional audio signals in order to provide a second mixed signal.

In some embodiments, the mixing performed by the first and/or second mixer may be based on a classification of a signal derived from the omni-directional microphone system and/or the directional microphone system.

In other embodiments, the mixing may be performed in dependence of a target signal-to-noise ratio (SNR) and/or a signal pressure level (SPL) of a signal derived from the omni-directional microphone system and/or the directional microphone system.

The binaural hearing aid system according to some embodiments may further comprise a user operated interface that is operatively connected to the first and/or second mixer.

According to other embodiments of the binaural hearing aid system, the first hearing impairment corrected output signal may at least in part be based on the first mixed signal. In addition to this or alternatively, the second hearing impairment corrected output signal may at least in part be based on the second mixed signal.

The first and second mixed signals may according to some embodiments be substantially identical or the mixing may be performed according to an identical mixing ratio.

In a preferred embodiment, the first hearing impairment corrected output signal may be generated in dependence of a hearing loss associated with a first ear of a user, and the second hearing impairment corrected output signal may be generated in dependence of a hearing loss associated with a second ear of a user.

According to some embodiments, the mixing may be performed in dependence of a hearing loss of a first and/or a second ear of a user.

According to some embodiments, a hearing aid system includes a first microphone and a second microphone for provision of electrical input signals, a beamformer for provision of a first audio signal based at least in part on the electrical input signals, the first audio signal having a directional spatial characteristic, wherein the beamformer is configured to provide a second audio signal based at least in part on the electrical input signals, the second audio signal having a spatial characteristic that is different from the directional spatial characteristic of the first audio signal, and a mixer configured for mixing the first audio signal and the second audio signal in order to provide an output signal to be heard by a user.

According to other embodiments, a hearing aid includes microphones for provision of a directional audio signal and an omni-directional audio signal, a processor operatively connected to the microphones, and configured for providing a hearing impairment corrected output signal to be heard by a user, and a mixer for mixing the directional audio signal and the omni-directional audio signal, thereby providing a mixed audio signal.

Other and further aspects and features will be evident from reading the following detailed description of the embodiments.

While several embodiments have been described above, it is to be understood that any feature from an embodiment may be included in any of other embodiments. Also, as used in this specification, the term "an embodiment" or similar terms, such as "some embodiments", "other embodiments" or "preferred embodiment" may refer to any one(s) of the embodiments described herein.

BRIEF DESCRIPTION OF THE DRAWINGS

In the following, embodiments are explained in more detail with reference to the drawing, wherein.

DESCRIPTION OF THE EMBODIMENTS

Figure 1:
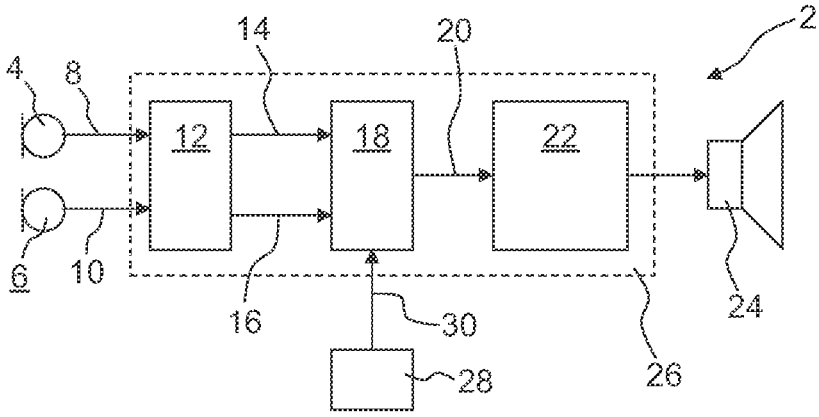
FIG. 1 shows a hearing aid system according to some embodiments.

The embodiments will now be described more fully hereinafter with reference to the accompanying drawings, in which exemplary embodiments are shown. It should be noted that the figures are not drawn to scale and that elements of similar structures or functions are represented by like reference numerals throughout the figures. Like elements will, thus, not be described in detail with respect to the description of each figure. It should also be noted that the figures are only intended to facilitate the description of the embodiments. They are not intended as an exhaustive description of the invention or as a limitation on the scope of the invention. The claimed invention may, however, be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 shows a hearing aid system according to some embodiments. The illustrated hearing aid system is embodied as a hearing aid 2, comprising two microphones 4 and 6, for the provision of the electrical input signals 8 and 10, respectively. The illustrated hearing aid 2 also comprises a beamformer 12 that is configured for providing a first audio signal 14 having a directional spatial characteristic (sometimes referred to as a beam). The first audio signal 14 is based at least in part on the electrical input signals 8 and 10, and the second audio signal 16 may also be based at least in part on the electrical input signals 8 and 10. The beamformer 12 is also configured for providing a second audio signal 16 having a spatial characteristic that is different from the spatial characteristic of the first audio signal 14. The first and second audio signals 14 and 16 are mixed in a mixer 18 in order to provide a mixed audio signal 20. The hearing aid 2 further comprises a compressor 22 that is configured for processing the mixed audio signal 20 according to a hearing impairment correction algorithm. The hearing impairment corrected mixed audio signal is subsequently transformed to a sound signal by the illustrated receiver 24. The beamformer 12, mixer 18 and compressor 22 are preferably comprised in a signal processor such as a digital signal processor (DSP) 26. It is understood that any or all of the units: Beamformer 12, mixer 18 or compressor 22 may be implemented in software. Furthermore, some parts of the units 12, 18 and 22 may be implemented in software, while other parts may be implemented in hardware, such as an ASIC. Since, most hearing disabilities are frequency dependent, the compressor 22 may preferably be configured to perform a frequency dependent processing of the mixed audio signal 20 according to a hearing impairment correction algorithm. This hearing impairment correction algorithm is preferably chosen or generated in dependence of a specific estimated or measured hearing impairment of a user of the hearing aid 2.

Also shown in FIG. 1 is a (optional) user operated interface 28, which is operatively connected to the mixer 18 via a control link 30. In one embodiment the illustrated user operated interface 28 may comprise an actuator or sensor (not shown), like a volume wheel, on a housing structure (not shown) of the hearing aid 2. This will thus enable the user to control the mixing of the first and second audio signals 14 and 16, by manually activating the actuator or sensor with his/her hand or fingers. In another embodiment the illustrated user interface 28 forms part of a remote control device, from which remote control device a wireless control signal 30 may be sent to and received at the hearing aid 2, in order to control the mixing of the first and second audio signals 14 and 16 in the mixer 18. In this embodiment it is understood that the hearing aid 2 is equipped with means for receiving a wireless control signal from the remote control device, although these features are not explicitly shown in FIG. 1.

It is furthermore understood that the illustrated hearing aid 2 may be a behind the ear type of hearing aid, a in the ear type of hearing aid, a completely in the canal type of hearing aid or a receiver in the ear type of hearing aid (i.e. a type of hearing aid, wherein all the features shown in FIG. 1 except the receiver 24 are placed in a housing structure configured for being placed behind the ear of a user, and wherein the receiver 24 is placed in an earpiece, which for example can be an earmould, configured for being placed in the ear canal or cavum concha of a user).

Figure 2:
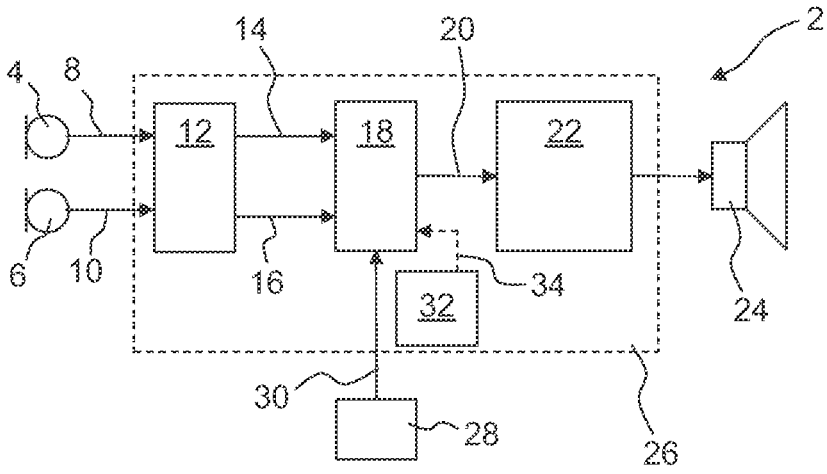
FIG. 2 shows a hearing aid system according to other embodiments.

FIG. 2 shows an alternative embodiment of the hearing aid system of FIG. 1. The only difference between the embodiment shown in FIGS. 1 and 2 is the classifier 32. By including the classifier 32 it is possible to let the hearing aid 2 perform an automatic mixing of the first and second audio signals 14 and 16, wherein the mixing may be optimized for different listening situations. For example if the ambient sound environment is quiet apart from possibly one sound source of interest for the user, then the mixing may be performed in such a way that the resulting mixed audio signal 20 is substantially omni-directional.

However, since it is impossible to a priori account for all possible listening situations and therefore not possible to optimize a mixing that would be optimal for the user in any possible listening situation, the user may overrule the automatic mixing controlled by the classifier 32. The user may do so by activating the user operated interface 28.

In a more simplified embodiment of the hearing aid 2 shown in FIG. 2 the mixing is only performed in dependence of a classification of the ambient sound environment by the classifier 32. Such an embodiment does therefore not comprise a user operated interface 28. In this simplified embodiment the user will, thus, not be able to overrule the mixing controlled by the classifier 32.

Figure 3:
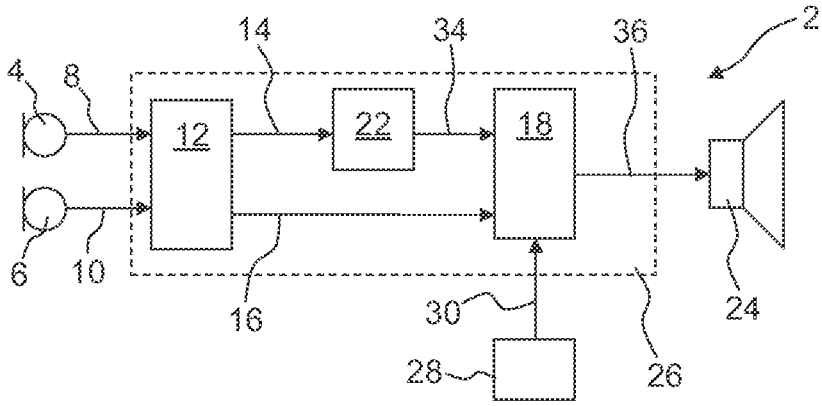
FIG. 3 shows a hearing aid system according to other embodiments.

FIG. 3 shows a hearing aid system according to other embodiments. The illustrated hearing aid system is embodied as a hearing aid 2 and is in many ways similar to the embodiment illustrated in FIG. 1 or 2. Thus only the differences to these embodiments will be described in detail. In the illustrated embodiment the compressor 22 is configured for processing the first audio signal 14 according to a hearing impairment correction algorithm in order to provide a hearing impairment corrected output signal 34. This may be advantageous in certain situations, because the beam formed audio signal 14 will usually be directed toward the sound source of interest to the user. The user will therefore be interested to hear that particular sound source as laud and clear as is convenient for him/her. However, in order to make it possible for the user to hear sounds from other directions as well and therefore to feel connected to the ambient sound environment, the signal 34 is mixed with the second audio signal 16 in order to provide a mixed output signal 36 that is converted to sound in a receiver 24. As illustrated the hearing aid system may also comprise a (optional) user operated interface 28, by which the mixing may be controlled by the user in a similar way as described above.

In an alternative embodiment of the hearing aid 2 illustrated in any of the FIGS. 1-3, the hearing aid may comprise one or two additional microphones, so that it all in all may comprises 3 or 4 microphones, or even more microphones than 4.

In another embodiment the hearing aid 2 as described with respect to any of the embodiments shown in FIG. 1-3 may be configured for forming part of a binaural hearing aid system comprising another hearing aid. The signal processing in the two hearing aids forming part of the binaural hearing aid system may further be coordinated with each other.

Figure 4:
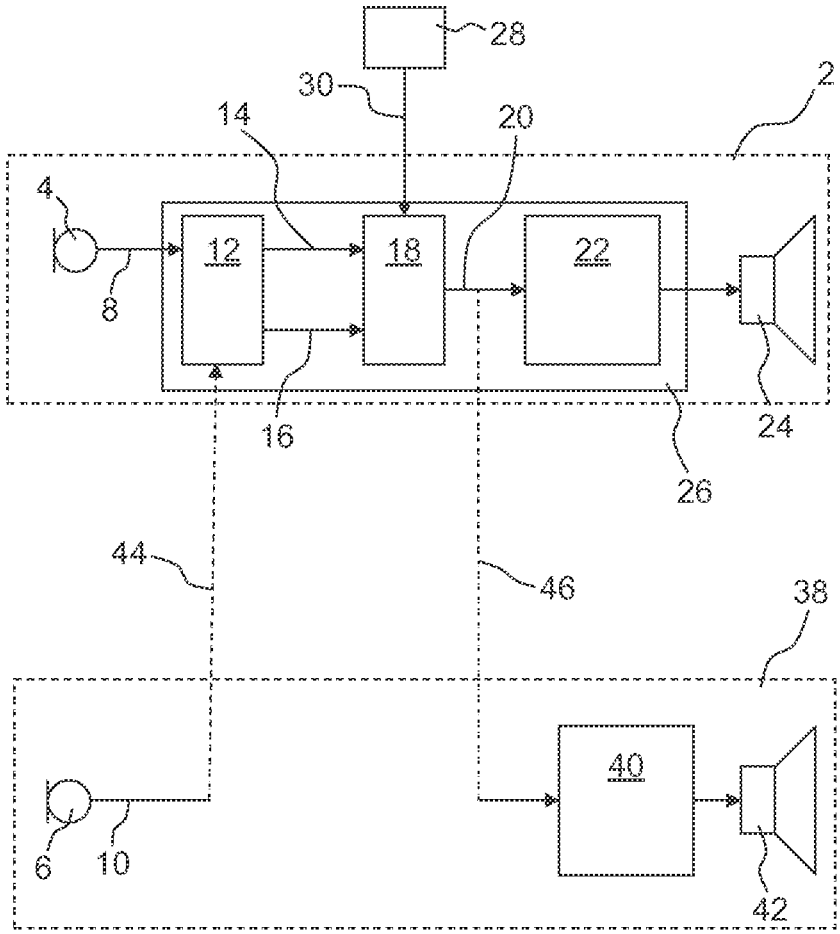
FIG. 4 shows a binaural hearing aid system according to some embodiments.

FIG. 4 shows a hearing aid system according to other embodiments, wherein the hearing aid system is a binaural hearing aid system, comprising a first hearing aid 2, with one microphone 4, and a second hearing aid 38 comprising a second microphone 6. The second hearing aid 38 further comprises a compressor 40 and a receiver 42. In the illustrated binaural hearing aid system, the beamforming is only performed in the hearing aid 2. Thus, the electrical input signal 10 provided by the second hearing aid 38 is transferred to the beamformer 12 in the first hearing aid 2, as indicated by the dashed arrow 44. The further processing of the electrical input signals 8 and 10 in the hearing aid 2, including mixing of the audio signals 14 and 16, is performed in a similar way as explained above with respect to the embodiments shown in FIG. 1-3. An important difference is, however, that the mixed output signal 20 is also transferred to the compressor 40 of the second hearing aid 38, as indicated by the dashed arrow 46. The compressor 40 preferably processes the mixed audio signal according to a hearing impairment correction algorithm in order to compensate for a hearing impairment of a second ear of a user. The output signal from the compressor 40 is then fed to a second receiver 42, which is configured for converting the output signal of the compressor into a sound signal to be heard by a user. Since, many people who suffer from a hearing handicap suffer from hearing loss in both ears, and in many cases even a different hearing loss in the two ears, the compressor 22 is preferably configured for processing the mixed audio signal 20 according to a hearing impairment correction algorithm in order to alleviate a hearing loss of a first ear of a user, while the compressor 40 of the second hearing aid 38 is configured for processing the mixed audio signal 20 according to a hearing impairment correction algorithm in order to alleviate a hearing loss of a second ear of a user.

Although not explicitly illustrated, the input signal 10 may be subjected to additional signal processing in the hearing aid 38.

The transferral of the signals 10 and 20, as indicated by the dashed arrows 44 and 46, between the two hearing aids 2 and 38, may be facilitated by a wired or wireless link (e.g. bi-directional link), as known in the art.

Figure 5:
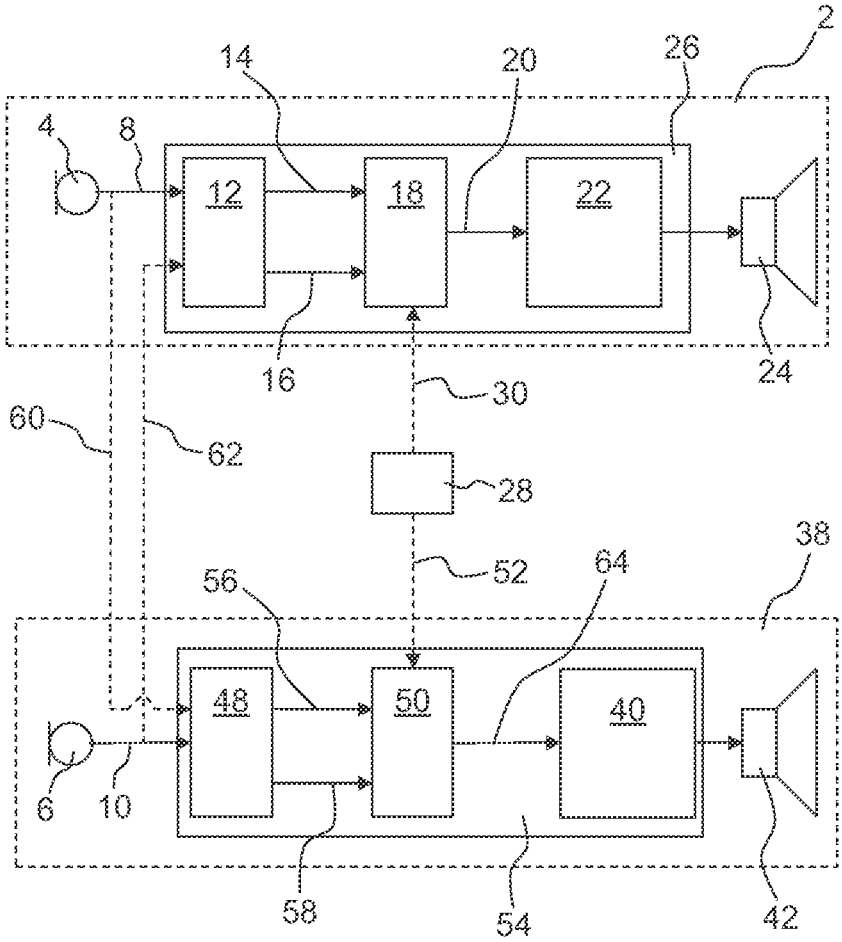
FIG. 5 shows a binaural hearing aid system according to other embodiments.

FIG. 5 shows a hearing aid system according other embodiments, here embodied as a binaural hearing aid system, comprising a first hearing aid 2 and a second hearing aid 38. Each of the illustrated hearing aids 2, 38 comprises: a microphone 4, 6, a beamformer 12, 48, a mixer 18, 50, a compressor and a receiver 24, 42. In the hearing aid 2, the beamformer 12, the mixer 18 and the compressor 22 are forming part of a signal processing unit, such as a digital signal processor (DSP) 26. Correspondingly, in the hearing aid 38, the beamformer 48, the mixer 50 and the compressor 40 are forming part of a signal processing unit, such as a digital signal processor (DSP) 54.

The microphone 4 of the first hearing aid 2, provides an electrical input signal 8, which is fed to the beamformer 12 and also transferred to the beamformer 48 of the second hearing aid 38 as indicated by the dashed arrow 60. Similarly, the microphone 6 of the second hearing aid 38, provides an electrical input signal 10, which is fed to the beamformer 48 and also transferred to the beamformer 12 of the first hearing aid 2 as indicated by the dashed arrow 62. Thus each of the beamformers 12 and 48 receive electrical signals provided by both of the microphones. The further processing of the electrical input signals 8, 10 in each of the hearing aids 2, 38 is performed in a similar manner as described above with respect to the embodiments shown in FIG. 1-3. The transferral of the input signals 8, 10 between the hearing aids 2, 38 as indicated by the dashed arrows 60, 62 may be facilitated by for example a bi-directional wired or wireless link.

In one embodiment of the binaural hearing aid system illustrated in FIG. 5, the beamformers 12, 48 of the first and second hearing aid 2, 38, may be configured to perform a coordinated beamforming in such a way that the audio signals 14 and 56 are substantially identical and/or that the audio signals 16 and 58 are substantially identical. This way it is achieved that the input signals to the mixer 18, 50 in the two hearing aids will be similar. As explained with respect to FIG. 4 above the compressors 22 and 40 are configured to process the mixed audio signals 20 and 64 according to the hearing loss of a first and a second ear of a user, respectively.

Also shown in FIG. 5 is a (optional) user operated interface 28. The illustrated user operated interface 28 is operatively connected to both the mixer 18 in the first hearing aid 2, as indicated by the dashed arrow 30, and to the mixer 50 in the second hearing aid 38, as indicated by the dashed arrow 52. In a preferred embodiment the user operated interface 28 forms part of a remote control device, whereby the operative connection between the user operated interface 28 and the hearing aids 2 and 38 may be facilitated by a wireless link by which control signals may be sent to each of the two hearing aids 2 and 38. In a preferred embodiment the user can control the mixing in each of the two hearing aids 2 and 38 independently of each other by a suitable activation of the user operated interface 28. In another embodiment the user operated interface 28 is configured for providing a coordinated and similar amount of mixing in each of the two hearing aids 2 and 38. In yet an alternative embodiment, the user operated interface 28 is comprised in a switching structure placed in a housing structure (not shown) of one or both of the hearing aids 2 and 38. Said switching structure may for example comprise a mechanical actuator or a proximity sensor or any other type of switching structure. In another embodiment the user operated interface 28 may be comprised of two separate parts, one for controlling the mixing in the hearing aid 2 and one for controlling the mixing in the hearing aid 38. Here it is understood that the user operated interface 28 also may comprise two separate parts of a switching structure (not shown), each of which may be placed in each of the two hearing aids 2 or 38. Thus, this way the mixing in the hearing aid 2 may be controlled by a switch (not shown) in the hearing aid 2 and the mixing in the hearing aid 38 may be controlled by a switch (not shown) in the hearing aid 38.

Figure 6:
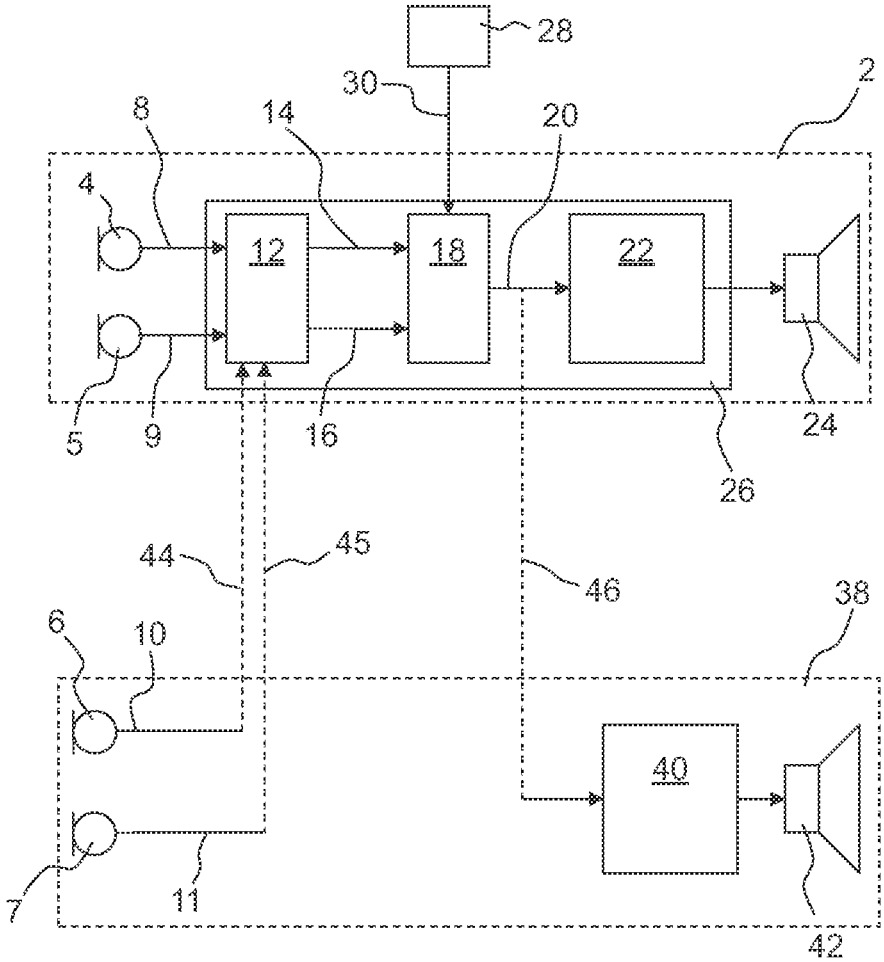
FIG. 6 illustrates a variation of the binaural hearing aid system of FIG. 4 accordance with other embodiments.

FIG. 6 illustrates a binaural hearing aid system similar to the one shown in FIG. 4, but now wherein each of the hearing aids 2, 38 has been equipped with one additional microphone 5 and 7 respectively. Hence, only the differences between the embodiment shown in FIG. 6 and FIG. 4 will be described: The additional microphone 5 in the hearing aid 2 provides an electrical input signal 9, which is fed to the beamformer 12, and the additional microphone 7 in the hearing aid 38 provides an electrical input signal 11, which is transferred to the beamformer 12 in the hearing aid 2 via a wired or wireless link, illustrated by the dashed arrow 45. Hereby the beamformer 12 will have four microphone signals to work on whereby a more accurate and precise beamforming is possible (as will be explained below).

The transferral of the signals 10, 11 and 20, as indicated by the dashed arrows 44, 45 and 46, between the two hearing aids 2 and 38, may be facilitated by a wired or wireless link (e.g. bi-directional link), as known in the art.

Figure 7:
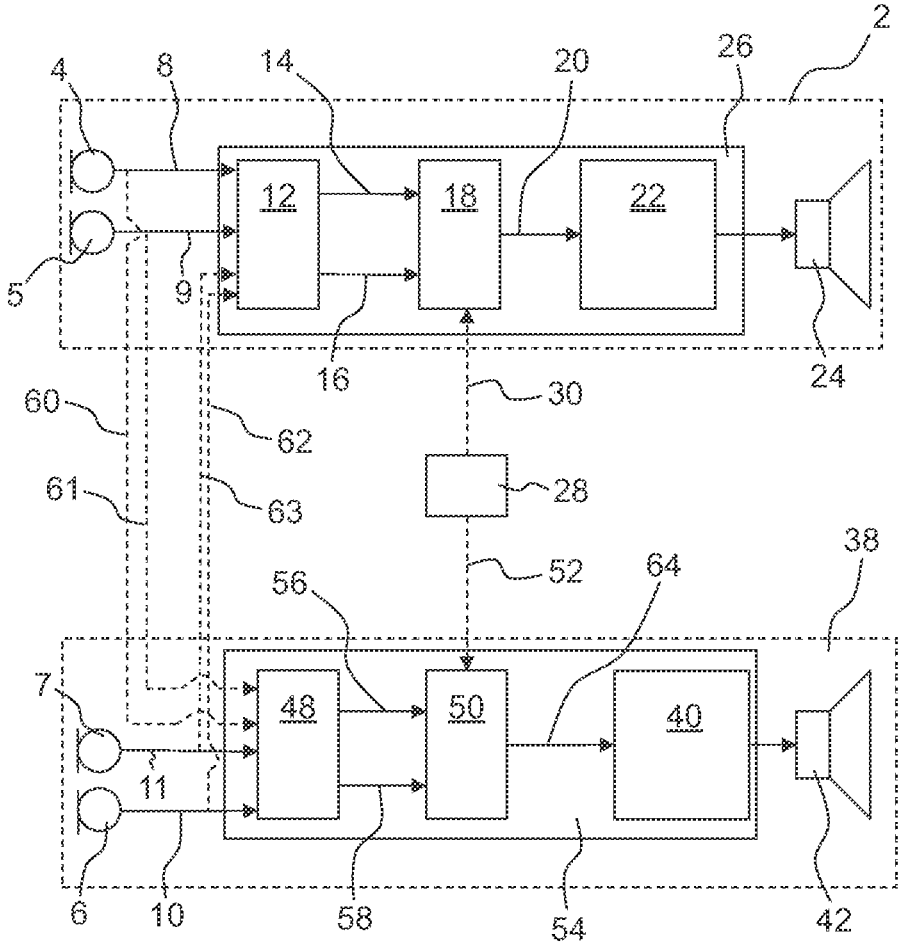
FIG. 7 illustrates a variation of the binaural hearing aid system of FIG. 5 accordance with other embodiments.

Similarly, FIG. 7 illustrates a binaural hearing aid system similar to the one shown in FIG. 5, but now wherein each of the hearing aids 2, 38 has been equipped with one additional microphone 5 and 7 respectively. Hence, only the differences between the embodiment shown in FIG. 7 and FIG. 5 will be described: The additional microphone 5 in the hearing aid 2 provides an electrical input signal 9, which is fed to the beamformer 12 and transferred to the hearing aid 38, preferably via a wired or wireless link, as illustrated by the dashed arrow 61, wherein it (9) is fed to the beamformer 48 in the hearing aid 38. Similarly, the additional microphone 7 in the hearing aid 38 provides an electrical input signal 11, which is feed to the beamformer 48 and transferred to the beamformer 12 in the hearing aid 2 via a (preferably wireless) link, illustrated by the dashed arrow 63. Hereby both the beamformer 12 and the beamformer 48 will have four microphone signals work on whereby a more accurate and precise beamforming is possible (as will be explained below). The beamforming performed by the two beamformers 12 and 48 may furthermore be coordinated with each other.

The transferral of the input signals 8, 9, 10 and 11 between the hearing aids 2, 38 as indicated by the dashed arrows 60, 61, 62 and 63 may be facilitated by for example a bi-directional wired or wireless link.

It is understood that the beamformer 12, 48 shown in any of the FIGS. 1-7 is preferably adaptive. Furthermore it is understood that each of the hearing aids 2, 38 illustrated in any of the FIGS. 3-7 may comprise a classifier (not shown) as described with respect to FIG. 2.

Figure 8A:
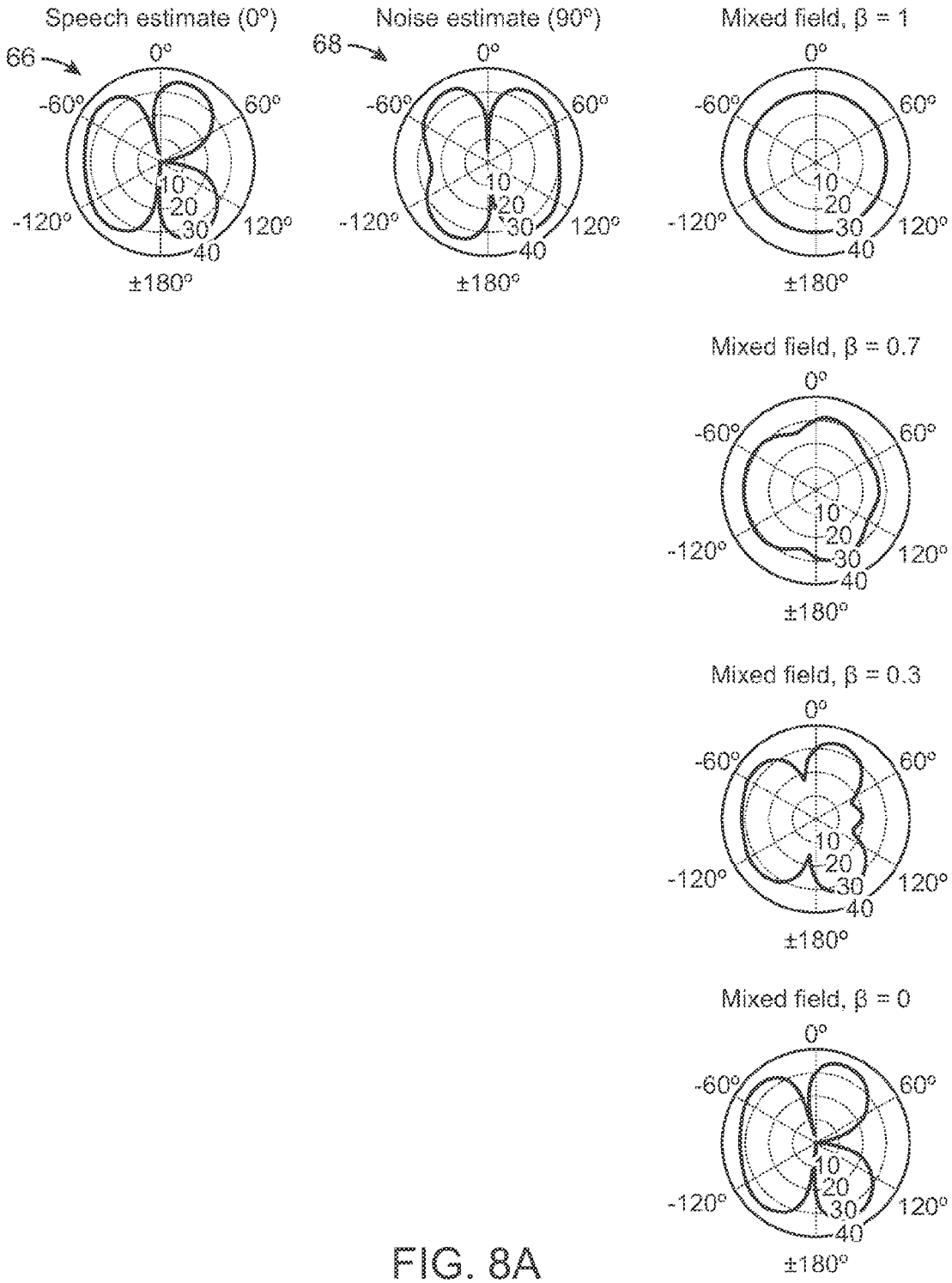
FIG. 8 illustrates the mixing of a first audio signal having a directional spatial characteristic with another audio signals having a spatial characteristic different from the spatial characteristic of the first audio signal.
Figure 8B:
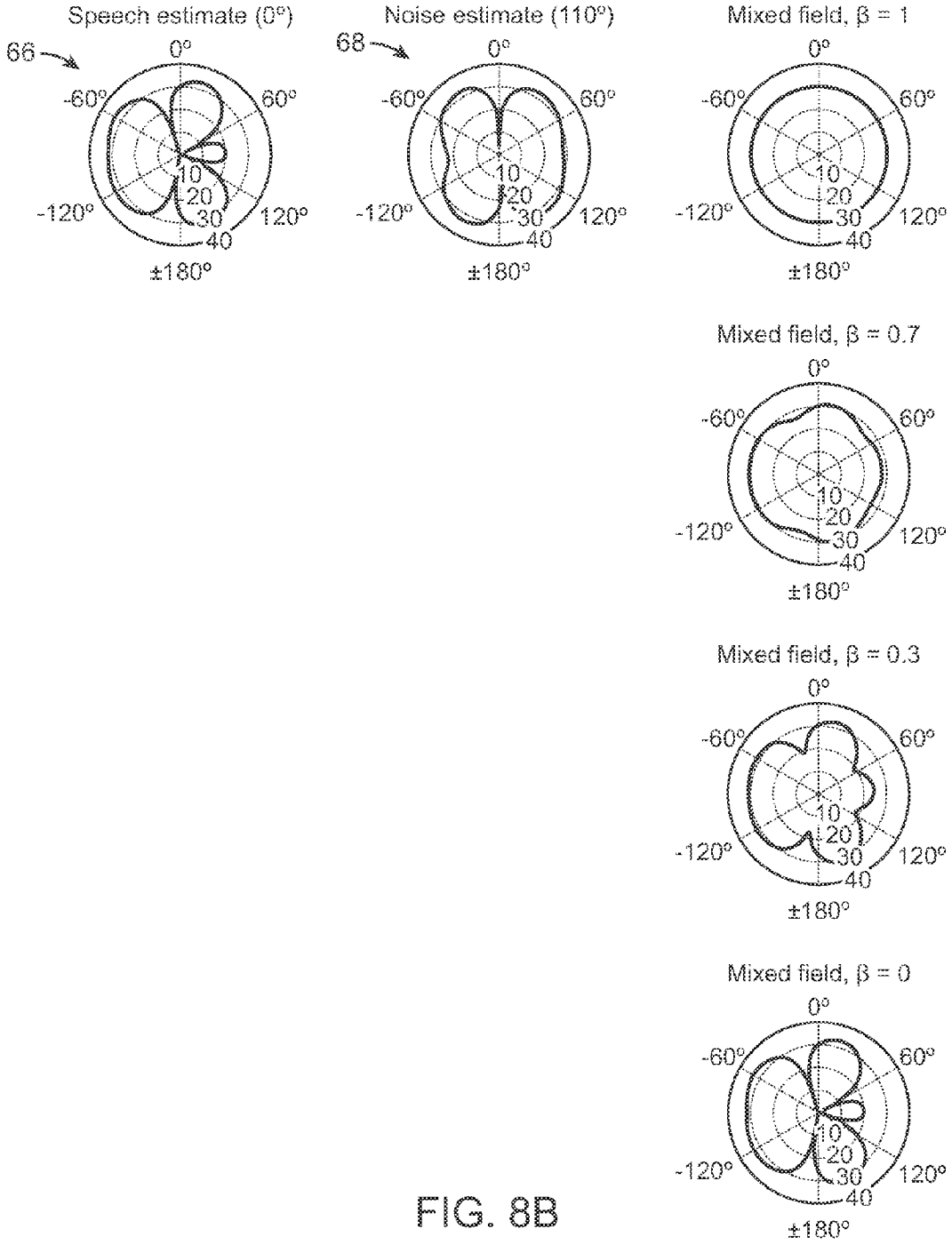
Figure 8C:
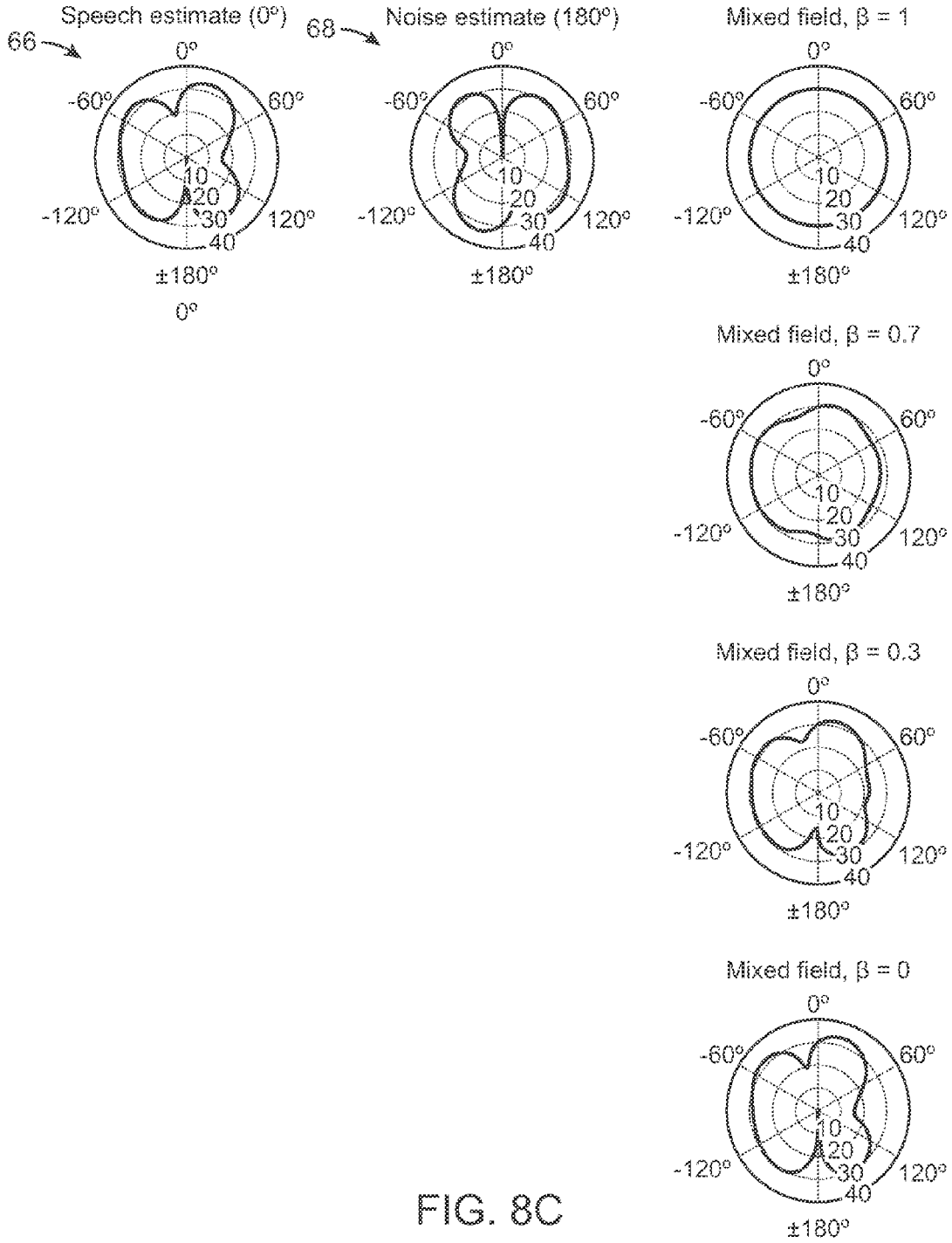

FIG. 8A-8C illustrates the mixing of a first audio signal having a directional spatial characteristic 66 with another audio signal having a spatial characteristic 68 different from the spatial characteristic 66 of the first audio signal in order to provide a mixed signal.

The spatial characteristics illustrated in FIG. 8A-8C, are given as polar plots showing the amplification of the ambient sound field as a function of angle in a substantially horizontal plane. The mixing illustrated in FIG. 8A shows a situation where a talker of interest to the user is placed at the angle θ degrees, and an interfering noise source is placed at the angle 90 degrees. The spatial characteristic 66 is the speech estimate provided by the beamformer, and the spatial characteristic 68 is the noise estimate provided by the beamformer. The last column of spatial characteristics illustrated in FIG. 8A shows the spatial characteristics of the resulting mixed signal for various values of the factor β (see e.g. equation (16) below for more details). The factor β illustrates how much of the noise estimate is mixed with the speech estimate. Thus, the value of β=1 corresponds to the situation, wherein all of the noise estimate is mixed with the speech estimate, resulting in an omni-directional mixed signal, and the other extreme situation, wherein the value of β=0 corresponds to the situation, wherein none of the noise estimate is mixed with the speech estimate, thus resulting in a mixed signal having spatial characteristic that is equal to the one of the speech estimate. Also illustrated in the last column of FIG. 8A are two intermediate situations showing the spatial characteristic of a mixed signal for β=0.3 and β=0.7. In a preferred embodiment, the mixing factor β is controllable by the user, so that he/she may decide how much of the noise estimate he/she may want to hear ad thereby control the "connectedness" to the ambient sound environment.

In FIGS. 8B and 8C is illustrated a similar situation as described above with reference to FIG. 8A, but with the difference that in FIG. 8B the interfering noise source is placed at the angle 110 degrees, and that in FIG. 8C the interfering noise source is placed at the angle 180 degrees.

The mixing illustrated in any of FIG. 8A-8C only shows two simple examples of the mixing that can be performed by the mixing units 18 or 50 illustrated in any of the FIGS. 1-7. Other kinds of mixing other than mere addition as illustrated in FIG. 8A-8C, e.g. some suitable weighing and multiplication may be envisioned, and mixing of other audio signals exhibiting different spatial characteristics is also possible. Thus, depending on the mixing ratio used, i.e. how the first and second signals are weighted relative to each other and on the generated spatial characteristic of the first and second audio signals, any desired spatial characteristic of the mixed signal may be achieved.

Below an example of the method of beamforming performed by the any of the beamformers 12 and/or 48 as illustrated in any of the FIGS. 1-7, will be described mathematically:

Considering an incident sound wave field at the time t described by $$y(r,t)=s(t-\alpha\cdot r)+w(r,t), \tag{1}$$

where s(t) is the propagating plane wave of interest (i.e. representing the signal of interest for the user) with slowness a (according to a preferred embodiment slowness is defined as the direction of propagation divided by the speed of sound in the medium) and where w(r,t) represents an interfering noise field. The inclusion of r and t in the arguments of the fields indicates that they are dependent on space and time. The incident wave field is sampled at M spatial locations (corresponding to M spatial microphone locations), thus generating M time signals $$y_m(t)=s(t-\alpha\cdot r_m)+w(r_m,t). \tag{2}$$

The beamformer then aligns the measured responses so that the signal of interest is in phase $$z_m(t)=y_m(t+\alpha\cdot r_m)=s(t)+w_m(t), \tag{3}$$

where $w_m(t)=w(r_m,t+a\cdot r_m)$. The corresponding sampled signal model can be written as $$z_m(n)=s(n)+w_m(n) \tag{4}$$

Then M−1 noise channels are generated $$v_m(n)=z_0(n)-z_m(n), m\neq 0. \tag{5}$$

The noise channels are written on vector form and filtered using a channel specific filter with N taps and the output is subtracted from the delayed signal reference (the first channel)

$$e(n) = z_0(n - N/2) - \sum_{m=1}^{M-1} h_m^T v_m(n), \tag{6}$$

where $(\cdot)^T$ is the transpose of $(\cdot)$ and $$h_m=(h_m(0) \ldots h_m(N-1))^T, \tag{7}$$

$$v_m(n)=(v_m(0) \ldots v_m(n-N+1))^T. \tag{8}$$

Equation (6) can be written more compactly as $$e(n)=z_0(n-N/2)-h^T v(n), \tag{9}$$

where $$h=(h_1^T \ldots h_{M-1}^T)^T, \tag{10}$$

$$v(n)=(v_1^T(n) \ldots v_{M-1}^T(n))^T. \tag{10}$$

The filters are chosen to minimize the mean squared error $$h_{opt}=E\{|e(n)|^2\}. \tag{12}$$

It is understood that this could be done online using an update scheme as the LMS (Least Means Squared), or the filters could be calculated at a fitting situation and fixed for a specific noise situation.

Assuming that the signal of interest is uncorrelated with the noise (which makes sense in most situations, because the signal of interest is usually a speech signal that has nothing to do with the interfering noise), an estimate of the noise process $w_0(n)$ is generated in this way of choosing the filters:

$$\hat{w}_0(n-N/2)=h^T v(n), \tag{13}$$

and from this result it follows that $$\hat{s}(n)=z_0(n)-\hat{w}_0(n), \tag{14}$$

and $$\hat{w}_m(n)=\hat{w}_0(n)-v_m(n), m\neq 0. \tag{15}$$

If it is assumed that the noise process $w_0(n)$ can be estimated with sufficient accuracy, the other four signals can also be extracted as shown in (14) and (15).

A modified estimate for the individual channels can now be found by $$x_m(n)=\hat{s}(n)+\beta_m \hat{w}_m(n), \tag{16}$$

where $\beta_m$ is a parameter controlling the signal-to-interference ratio of the different channels, i.e. how much of the noise estimate is mixed with the speech estimate.

Simulation Results

The method has been tested in simulations, wherein a binaural hearing aid system according to some embodiments described herein (hereafter called binaural beamformer) was compared to the unprocessed signal and a monaural adaptive beamformer. In the simulations a free field model was used, and far field propagation was assumed, i.e. the acoustic model was based on a farfield approximation. The array had four microphones with two on either side of the head, i.e. corresponding to a binaural hearing aid system according to some embodiments comprising two hearing aids, each equipped with two microphones, a front microphone and a rear microphone. The distance between the microphones on the individual hearing aid was 1 cm and the distance between the two front microphones was 14 cm whereas the distance between the two rear microphones was 15 cm. The speed of sound was assumed to be 342 m/s and the sampling frequency of the entire binaural hearing aid system was 16 kHz. The filters associated with a specific noise channel $h_m$ had 21 taps, resulting in a processing delay of 10 samples of the target signal. A speech signal was played from 0 degrees. The thermal noise was assumed to be spatially and temporally white with a Gaussian distribution. The level of the noise was adjusted so that the SNR was 30 dB (corresponding to a sound pressure level of 60 dB and a microphone noise level of 30 dB).

Figure 9:
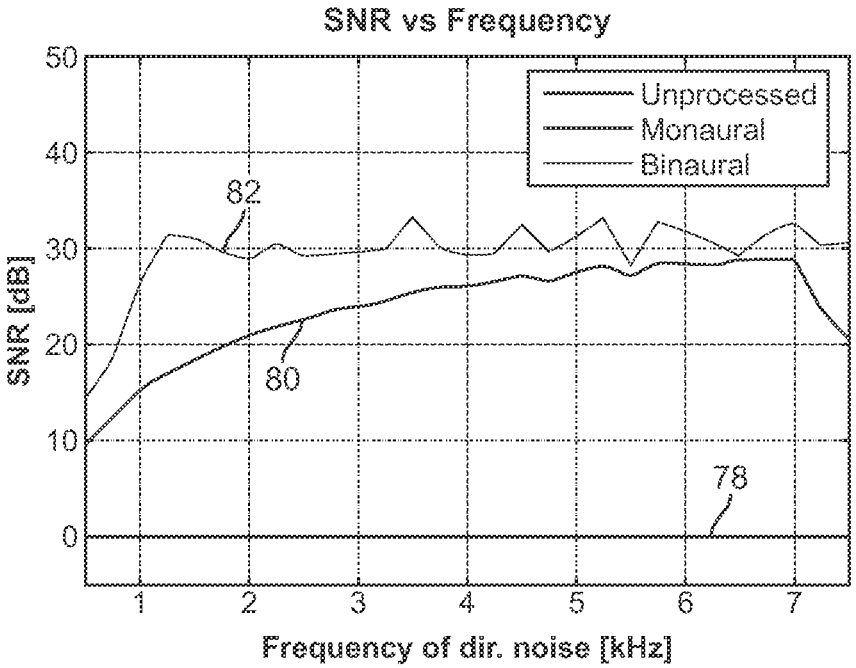
FIG. 9 illustrates a frequency dependent performance of hearing aid systems according to some embodiments in simulations.

Frequency Dependent Performance:

In this simulation only one interfering source was used. The interfering source was in this case a band limited directional noise component. The angle of incidence was 90 degrees compared to the microphone array. The bandwidth of the noise component was 1 kHz and was uncorrelated with the target signal coming from the front. The center frequency of the noise component was varied from 500 Hz-7.5 kHz. The parameter β was in this case chosen to give maximum attenuation of the noise ($\beta_m$=0). The result can be seen in FIG. 9. The curve 78 describes the unprocessed signals on either of the (omnidirectional) microphones, the curve 80 shows the SNR for the monaural hearing aid and the curve 82 is the result for the binaural hearing aid system. The binaural hearing aid system outperforms the monaural hearing aid for low frequencies whereas the discrepancy is less for the higher frequencies.

Figure 10:
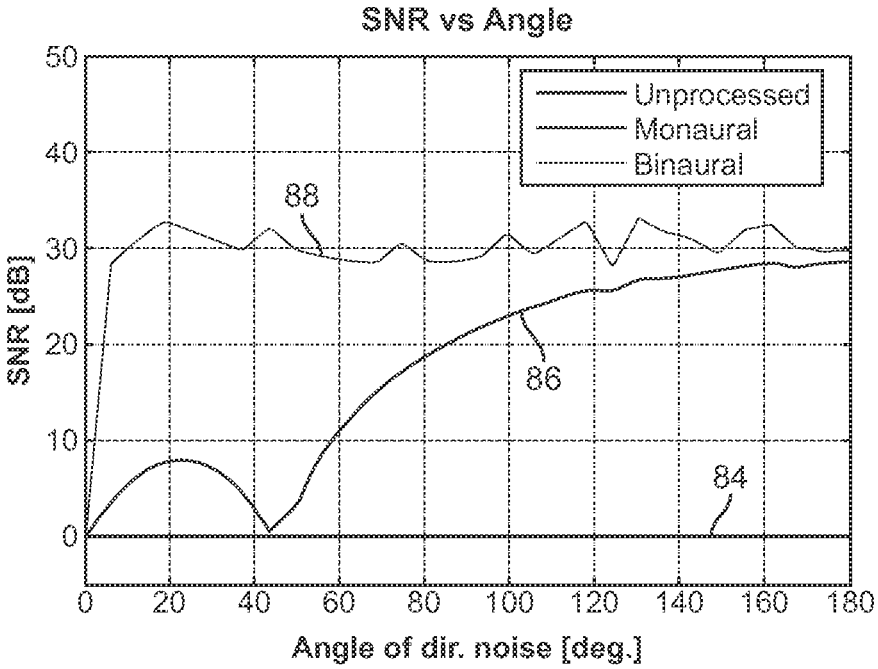
FIG. 10 illustrates a angle dependent performance of hearing aid systems according to some embodiments in simulations.

Angle Dependent Performance:

Also in this simulation only one interfering source was used. The interfering source was in this case a band limited directional noise component. The center frequency of the noise was 2 kHz and the bandwidth of the noise component was 1 kHz and was uncorrelated with the target signal coming from the front. The angle of incidence was varied from 0-90 degrees. The parameter β was also in this case chosen to give maximum attenuation of the noise ($\beta_m$=0). The result can be seen in FIG. 10. The curve 84 describes the unprocessed signals on either of the microphones, the curve 86 shows the SNR for the monaural hearing aid and the curve 88 is the result for the binaural hearing aid system. The binaural hearing aid has a much better performance than the monaural hearing aid for angles between 0 and 90 degrees, whereas the two systems show similar performance in the rear hemisphere.

Multiple Noise Sources:

One of the benefits from having more microphones is that the beamformer has more degrees of freedom to work with. Thus a further simulation was performed in order to show the difference in performance for multiple sources. For this simulation three interfering sources were incident from 90, 120 and 180 degrees. The center frequency for all noise sources chosen to be 2 kHz and the bandwidth was 1 kHz. The noise sources were mutually uncorrelated and uncorrelated with the target signal. In table 1, the SNR can be seen for the three test cases. Here the advantage of the binaural hearing aid system is evident with a SNR gain of approximately 29 dB, whereas the monaural hearing aid only gives a SNR increase of 8 dB.

TABLE 1

| Method | SNR |
|---|---|
| Unprocessed | −4.8 dB |
| Monoaural | 2.5 dB |
| Binaural | 24.5 dB |

Performance in Diffuse Noise:

Performance in diffuse noise is very interesting for hearing aid applications, because such noise fields are often encountered in highly reverberant settings such as in meeting rooms, restaurants or cafeterias. Thus, a simulation for diffuse noise was also performed, wherein the diffuse noise field was simulated as $$d(r, t) = \sum_{i=0}^{I-1} g(t) * p(t - \alpha_i \cdot r), \tag{17}$$

where g(t) is a linear phase low pass filter with a cut off frequency of 6 kHz convolved with a delayed version of p(t) which is a white stochastic time signal with zero mean and Gaussian distribution. The variable $\alpha_i$ is given by $$\alpha_i = (\sin\theta_i \cos\theta_i)^T / c, \tag{18}$$

where $\theta_i$ is a stochastic angle of incidence with a uniform distribution across the interval $[0,2\pi]$ and c is the speed of sound. The number of waves was chosen to be I=2000. The diffuse wave field was evaluated in the positions of the microphones and sampled to generate the discrete time noise sequences. The result for the different test cases can be seen in table 2.

TABLE 2

| Method | SNR |
|---|---|
| Unprocessed | −3.3 dB |
| Monoaural | 0.57 dB |
| Binaural | 3.0 dB |

It is noticeable that the performance gain is much less than for the directional noise situation both for the binaural and the monaural hearing aid. The SNR gain for the monaural hearing aid is about 4 dB and 6 dB for the binaural hearing aid system.

Figure 11:
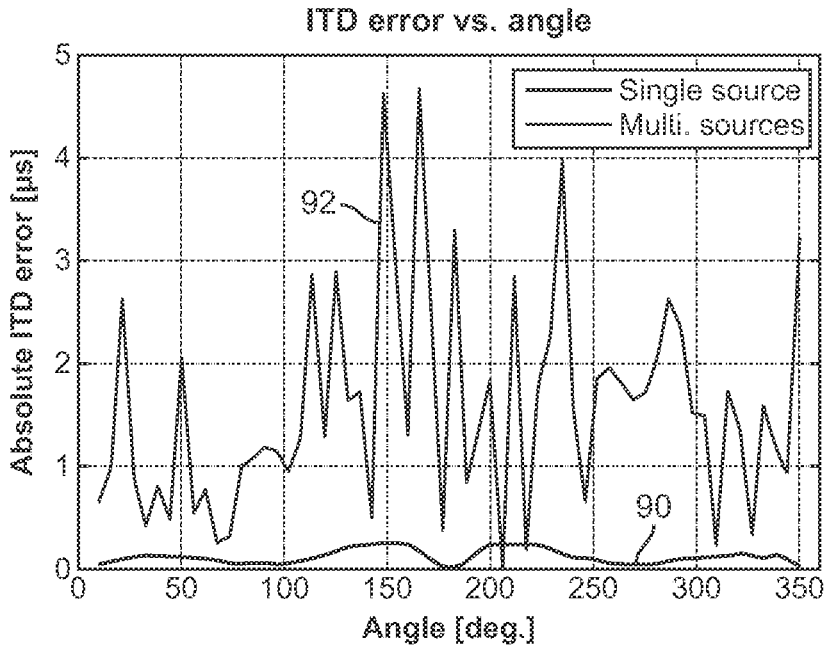
FIG. 11 illustrates an error in Interaural Time Difference for single and multiple noise sources, respectively, as a function of incident angle.

Important localisation cues are the Interaural Time Difference (ITD) and the Interaural Level Difference (ILD). Hence, these binaural cues have also been investigated through simulations:

Interaural Time Difference:

First the ability of reproducing the correct ITD of directional noise sources was investigated by simulations. In a first simulation, a single noise component was present in the wave field. The center frequency of the noise was chosen to be 2 kHz and the bandwidth of the noise component was chosen to be 1 kHz and was uncorrelated with the target signal coming from the front. The angle of incidence was varied from 10-350 degrees. The ITD between a channel on the right ear and the corresponding channel on the left ear was calculated. This was achieved by finding the interpolated peak in the cross-correlation function of the noise estimate of the two different channels. This value was compared to the true ITD of the directional noise component. The error in microseconds is shown as the curve 90 in FIG. 11. The error is symmetric around 0 and 180 degrees due to the linear array geometry of the two microphones under investigation.

A corresponding simulation was carried out where two other uncorrelated interfering sources were also active. The noise sources were incident from 90 and 180 degrees and had the same spectral characteristics as the noise source under investigation. Again, the ITD error was calculated between the estimated ITD and the true ITD of the source. The result is displayed as the curve 92 in FIG. 11. It can be seen that the ITD error is larger for the multiple noise case compared to the single noise source situation. However, the error is still very small compared to the true ITD between the ears which is on the order of ms.

Figure 12:
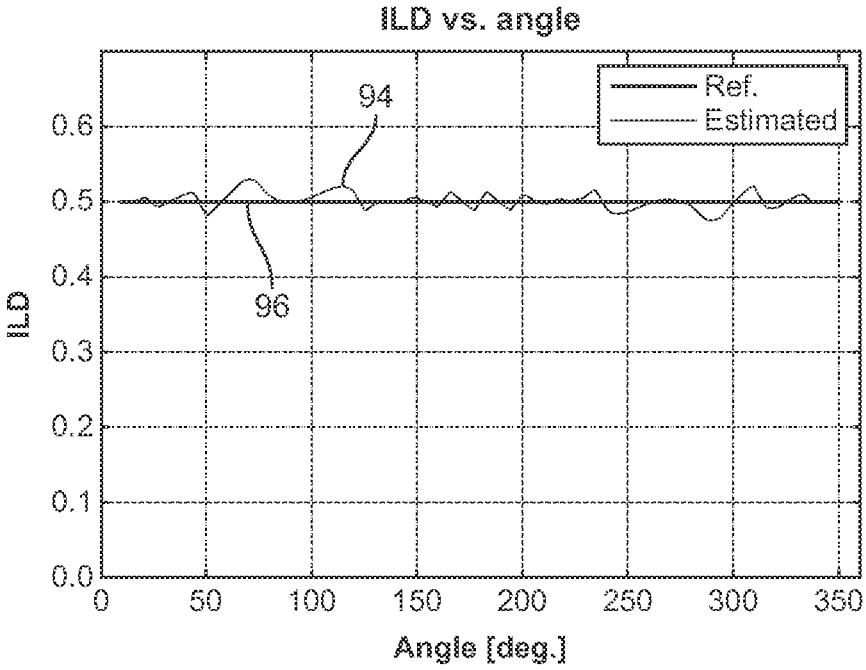
FIG. 12 illustrates estimated Interaural Level Difference as a function of incident angle.

Interaural Level Difference:

The beamforming method was also tested with respect to ILD. A single noise component was present in the wave field. The center frequency of the noise was chosen to be 2 kHz and the bandwidth of the noise component was 1 kHz and was uncorrelated with the target signal coming from the front. The angle of incidence was varied from 10-350 degrees. Before the speech signals and the noise signals were combined, the noise signals on the right side of the head were multiplied by a factor of ½. The ILD was estimated by extracting the noise components on both sides of the head and computing the ratio of the maximum of the respective auto-correlation functions. In FIG. 12, the estimated ILD is given in by the curve 94 and the true ILD is given by the straight curve 96. The simulations show that the beamforming method is able to reproduce the correct ILD of the wave field.

In the present patent specification is described an adaptive beamforming algorithm for hearing aids with a binaural coupling between the hearing aids on opposite sides of the head. However, it should be understood that a non-adaptive beamforming algorithm could be used as well. One of the key concerns when designing binaural algorithms is that although the beamformer should suppress unwanted directional interference, it should not destroy the binaural cues for the interference which would be used for target location by the user of the hearing aid system according to some embodiments.

The proposed algorithm generates an estimate for the signal incident from the target direction (usually chosen to be fixed at 0 degrees) but also gives an estimate for the noise component on all microphones. The signal presented at the output (which is then passed on for further processing in the hearing aid) is an appropriate mixing of target signal and noise. The mixing ratio could either be adjusted by the user by a remote control or decided by the hearing aid given the current acoustic environment.

Simulations as presented in the present patent specification are only relating to the directional noise suppression performance, i.e. only target signal and no noise mixing, and compared to that of a single hearing aid with adaptive beamforming. When only one directional noise source was present, it was shown that the monoaural hearing aid performed better than if no beamforming was applied, but also that the binaural hearing aid system performed significantly better than the monaural hearing aid for all angles and especially in the front hemisphere. The same applied to different frequencies of the noise. Here, the performance gain was the largest in the low frequencies. When three directional noise sources were present in the field, the performance gain of the monaural hearing aid was 8 dB. This is a result of that the small number of microphones in the array (only 2) cannot suppress this number of sources properly. The binaural array (with 4 microphones), however, achieved a SNR gain of 28 dB. Simulations were also carried out for a diffuse noise field. The performance of the beamforming algorithms were, however, reduced, with a SNR gain of 4 dB for the monaural hearing aid and 6 dB for the binaural hearing aid system, respectively.

The ability of the proposed algorithm to reproduce ITD and ILD of the interfering noise was also evaluated. It was shown that the error in the estimated ITD was on the order of microseconds for both single interferer situations as well as for the case of multiple interfering noise sources. This has to be considered as small since the true ITD is in the millisecond range. It was also shown that the ILD was correctly reproduced when a single interfering source generated different pressure levels on the two sides of the head.

Thus, as illustrated above, beamforming and mixing of audio signals is feasible and advantageous to use in a hearing aid system. However, as will be understood by those familiar in the art, the claimed invention may be embodied in other specific forms than those described above and illustrated in the drawings and may utilize any of a variety of different algorithms without departing from the spirit or essential characteristics thereof. For example the selection of an algorithm is typically application specific, the selection depending upon a variety of factors including the expected processing complexity and computational load.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid system, comprising:

a first microphone and a second microphone for provision of electrical input signals;

a beamformer for provision of a first audio signal based at least in part on the electrical input signals, the first audio signal having a directional spatial characteristic, wherein the beamformer is configured to provide a second audio signal based at least in part on the electrical input signals, the second audio signal having a spatial characteristic that is different from the directional spatial characteristic of the first audio signal; and a mixer configured for mixing the first audio signal and the second audio signal in order to provide an output signal to be heard by a user;

wherein the first and second microphones are parts of a binaural hearing aid system that includes a first hearing aid and a second hearing aid communicatively coupled to each other via a communication link;

wherein the first microphone is located in the first hearing aid and the second microphone is located in the second hearing aid; and wherein each of the first and second hearing aids comprises an additional microphone that is communicatively connected to the beamformer.

2. The hearing aid system according to claim 1, wherein the mixer is configured to mix the first audio signal and the second signal to obtain a mixed signal, and the hearing aid system further comprises a processor that is configured to process the mixed signal according to a hearing impairment correction algorithm.

3. The hearing aid system according to claim 1, further comprising a processor that is configured to process the first audio signal according to a hearing impairment correction algorithm prior to mixing the first and second audio signals.

4. The hearing aid system according to claim 1, wherein the beamformer is adaptive.

5. The hearing aid system according to claim 1, further comprising a user operated interface operatively connected to the mixer for controlling the mixing of the first and second audio signals.

6. The hearing aid system according to claim 5, wherein the user operated interface is at a separate remote control device that is operatively connected to the mixer via a wireless link.

7. The hearing aid system according to claim 5, wherein the user operated interface comprises a manually operable switch.

8. A hearing aid system, comprising:

a first microphone and a second microphone for provision of electrical input signals;

a beamformer for provision of a first audio signal based at least in part on the electrical input signals, the first audio signal having a directional spatial characteristic, wherein the beamformer is configured to provide a second audio signal based at least in part on the electrical input signals, the second audio signal having a spatial characteristic that is different from the directional spatial characteristic of the first audio signal;

a mixer configured for mixing the first audio signal and the second audio signal in order to provide an output signal to be heard by a user; and a user operated interface operatively connected to the mixer for controlling the mixing of the first and second audio signals;

wherein the first and second microphones are parts of a binaural hearing aid system that includes a first hearing aid and a second hearing aid communicatively coupled to each other via a communication link;

wherein the first microphone is located in the first hearing aid and the second microphone is located in the second hearing aid; and wherein the user operated interface includes a manually operable switch at the first hearing aid.

9. The hearing aid system according to claim 8, wherein the user operated interface further includes a second manually operable switch at the second hearing aid.

10. The hearing aid system according to claim 1, wherein the spatial characteristic of the first audio signal and the spatial characteristic of the second audio signal are substantially complementary.

11. The hearing aid system according to claim 1, wherein the spatial characteristic of the second audio signal is substantially omni-directional.

12. The hearing aid system according to claim 1, wherein the beamformer is configured to generate the first and second audio signals in a way such that a resulting spatial characteristic of the mixed audio signal is substantially omni-directional.

* * * * *